US005703032A

United States Patent [19]

Bae-Lee et al.

[11] Patent Number: 5,703,032

[45] Date of Patent: Dec. 30, 1997

[54] HEAVY DUTY LIQUID DETERGENT COMPOSITION COMPRISING CELLULASE STABILIZATION SYSTEM

[75] Inventors: Myongsuk Bae-Lee, Montville; Nancy Falk, Livingston; Tirucherai Varahan Vasudevan, West Orange, all of N.J.

[73] Assignee: Lever Brothers Company, Division of Conopco, Inc., New York, N.Y.

[21] Appl. No.: 611,910

[22] Filed: Mar. 6, 1996

[51] Int. Cl.[6] ..... C11D 3/386

[52] U.S. Cl. ..... 510/320; 510/321; 510/337; 510/393; 510/530; 435/180; 435/263

[58] Field of Search ..... 435/263, 180; 510/320, 321, 387, 393, 530

[56] References Cited

U.S. PATENT DOCUMENTS

| | | | |
|---|---|---|---|
| 4,747,977 | 5/1988 | Whitehead et al. | 510/321 |
| 5,246,853 | 9/1993 | Clarkson et al. | 435/263 |
| 5,269,960 | 12/1993 | Gray et al. | 510/303 |
| 5,290,474 | 3/1994 | Clarkson et al. | 510/320 |
| 5,328,841 | 7/1994 | Lorch et al. | 435/209 |
| 5,419,778 | 5/1995 | Clarkson et al. | 8/116 |
| 5,525,507 | 6/1996 | Clarkson et al. | 435/263 |

FOREIGN PATENT DOCUMENTS

| | | |
|---|---|---|
| 0508358 | 10/1992 | European Pat. Off. . |
| 0576777 | 1/1994 | European Pat. Off. . |
| 0587550 | 3/1994 | European Pat. Off. . |
| 9500635 | 1/1995 | WIPO . |

*Primary Examiner*—Paul Lieberman
*Assistant Examiner*—Kery A. Fries
*Attorney, Agent, or Firm*—Ronald A. Koatz

[57] ABSTRACT

The present invention relates to a specific ternary enzyme stabilization system which unexpectedly enhances stability of a specific cellulase enzyme in isotropic liquid detergent compositions.

5 Claims, No Drawings

HEAVY DUTY LIQUID DETERGENT COMPOSITION COMPRISING CELLULASE STABILIZATION SYSTEM

BACKGROUND OF THE INVENTION

1. Field of the Invention

The present invention relates to heavy duty liquid detergent compositions containing enzymes, particularly those containing cellulases. In particular, the invention relates to stabilization systems for these enzymes.

2. Background Art

Cellulases (e.g., Endoglucanase III from Genencor) are known to provide improved color care (i.e., to lessen the dulling and fading of colors on cellulose fabrics such as cotton) in liquid detergent compositions. Unfortunately, endoglucanase is quite unstable in isotropic (i.e., non-structured) liquid compositions. Endoglucanases are unusual in this regard because other enzymes, even other types of cellulases generally are stable in typical isotropic compositions (e.g., those generally stabilized using boron containing compounds and/or low molecular weight alcohols/polyols).

Unexpectedly, applicants have found that, utilizing a specific enzyme stabilization system, stability of endoglucanase III (EG III) can be remarkably enhanced. The stabilization system comprises (1) water soluble, hydrophobic, nonionic polymers (e.g., polyvinylpyrrolidone), (2) alkylene glycol; and (3) a hydrophilic amine (e.g., alkanolamines).

The use of alkylene glycol (e.g., propylene glycol) in combination with polyvinylpyrrolidone and monoethanolamine is taught, for example, in EP 576,777, assigned to Procter & Gamble. The compositions of that reference, however, differ significantly from the compositions of the subject invention.

First, the levels of amine (i.e., 9% & 12.6%) used in the examples (the only place where it appears to be pertinent) are levels which are so high that they would make the compositions of the subject invention unstable. Thus, as shown in our examples, at levels higher than about 7%, the compositions of our invention would be unstable.

Further, the compositions of the subject invention may contain no more than 5% by wt. fatty acid because higher levels would impart an odor unacceptable to the product. By contrast, the examples of EP 576,777 show compositions comprising 11% fatty acid.

Finally, there is absolutely no teaching or suggestion that the specific combination of alkylene glycol, selected nonionic polymers and hydrophilic amine at the specified levels would have a tremendous synergistic effect on the stability of any enzyme, let alone cellulase and, in particular, Endoglucanase III from Genencor. The prior art teaches only boric acid, propylene glycol, carboxylic acids and mixtures thereof as enzyme stabilizers. It is also noted that EP 576,777 requires a terephthalate polymer (to insure the product is clear) while the compositions of the subject invention certainly do not require such a compound.

EP 508,358 and EP 587,550 (assigned to Procter & Gamble) teach laundry detergent compositions comprising propylene glycol and polyvinylpyrrolidone (508,358) or poly(4-vinylpyridine)-N-oxide (587,550) in combination with cellulase.

The levels of alkylene glycol used (e.g., 2% or less propylene glycol) are too low to stabilize Endoglucanase III, even in the presence of PVP and alkanol amines. The compositions of the subject invention require at least 5% alkylene glycol as also shown in Example 1 of the subject invention, for example (i.e., wherein 3.3% does not work).

In addition, there is absolutely no teaching or suggestion that the specific combination of selected nonionic polymer, hydrophilic amine and alkylene glycol at defined levels have the demonstrated synergetic effect on any particular enzyme, specifically on Endoglucanase III.

Finally, it is noted that the Endoglucanase III of the present invention is different from the alkaline endoglucanase or cellulase from *Humicola insolens* taught in the prior art reference.

WO 95/00635 (assigned to Procter & Gamble) teaches a liquid detergent composition using hydrophobic amines as stabilizing agents for cellulase. These compositions do not contain selected nonionic polymers as defined by the invention. Also, monoethanolamine, a hydrophilic amine, has no effect on the stability of the prior art cellulase as exemplified in the prior art example (i.e., there was no stabilization effect). In our composition, it was found that amines by themselves (hydrophilic or hydrophobic) only marginally improve the stability of Endoglucanase III from Genencor, but has a drastic effect only in the presence of certain minimum levels of defined nonionic polymers and alkylene glycol. Additionally, in contrast to prior art findings, hydrophilic amines (such as used in our invention) impart more stability than hydrophobic amines.

None of the prior art references teaches or suggests that a specific ternary stabilization system wherein each component is used in specific amounts has an unexpected and remarkably synergistic effect on the stability of a very specific cellulase protein, i.e., Endoglucanase III from Genencor.

BRIEF SUMMARY OF THE INVENTION

Unexpectedly, applicants have now found a specific ternary enzyme stabilization system for a specific cellulase enzyme wherein the combination of ingredients in the ternary system remarkably and unexpectedly enhances the stability of the enzyme.

Specifically, the invention relates to an aqueous surfactant composition comprising:

(1) 1% to 50% by wt. of a surfactant selected from the group consisting of anionic, nonionic, cationic, zwitterionic, and amphoteric surfactants and mixtures thereof;

(2) a ternary system for stabilizing Endoglucanase III comprising:

(a) 0.1% to 10% by wt., based on total composition, of a water soluble, hydrophobic nonionic polymer;

(b) 5% to 25% by wt., based on total composition, of a $C_2$–$C_6$ alkylene glycol; and (c) 0.1% to 7% by wt., based on total composition, of a hydrophilic amine (e.g., ethanolamine); and (3) cellulase enzyme wherein said enzyme comprises 0.001% to 5.0% by wt. of Endoglucanase III wherein fatty acid content is below about 5%.

DETAILED DESCRIPTION OF THE INVENTION

The present invention relates to aqueous liquid detergent compositions comprising a combination of ingredients (i.e., specific ternary enzyme stabilization system) which combination has been unexpectedly found to stabilize a specific cellulase. This cellulase has previously been extremely difficult to stabilize in liquid detergent composition.

Surfactant System

The surfactant used in the compositions of the invention may be selected from the groups consisting of anionics, nonionics, zwitterionics, amphoteric and cationic surfactants.

Suitable surfactants for use in the compositions according to the present invention include anionic surfactants which may include, but are not limited to, water-soluble salts of alkyl benzene sulphonates, alkyl sulphates, alkyl polyethoxy ether sulphates, paraffin sulphonates, alpha-olefin sulphonates, alpha-sulphoalkylcarboxylates and their esters, alkyl glyceryl ether sulphonates, fatty acid monoglyceride sulphates and sulphonates, alkyl phenol polyethoxyl ether sulphates, 2-acyloxy-alkane-1-sulphonates, and beta alkyloxy sulphonates.

Especially preferred alkyl benzene sulphonates have 9 to 15 carbon atoms in a linear or branched alkyl chain, especially from 11 to 13 carbon atoms. Suitable alkyl sulphates have from 10 to 22 carbon atoms in the alkyl chain, more especially from 12 to 18 carbon atoms. The alkyl chain of the sulphate may be branched or unbranched and, if branched, preferably contains greater than 20% branching. Suitable alkyl polyethoxy sulphates have from 10 to 18 carbon atoms in the alkyl chain and have an average of from 1 to 23 $CH_2CH_2O$ groups per molecule, especially from 10 to 16 carbon atoms in the alkyl chain and an average of from 1 to 6 $CH_2CH_2O$ groups per molecule.

Suitable paraffin sulphonates are essentially linear and contain from 8 to 24 carbon atoms, more especially from 14 to 18 carbon atoms. Suitable alpha-olefin sulphonates have from 10 to 24 carbon atoms, more especially from 14 to 16 carbon atoms; alpha-olefin sulphonates can be made by reaction with sulphur trioxide, followed by neutralization under conditions such that any sulfonates present are hydrolyzed to the corresponding hydroxy alkane sulphonates. Suitable alpha-sulphocarboxylates contain from 6 to 20 carbon atoms; included herein are not only the salts of alpha-sulphonated fatty acids but also their esters made from alcohols containing 1 to 14 carbon atoms.

Suitable alkyl glyceryl ether sulphates are ethers of alcohols having from 10 to 18 carbon atoms, more especially those derived from coconut oil and tallow. Suitable alkyl phenol polyethoxy ether sulphates have from 8 to 12 carbon atoms in the alkyl chain and an average of from 1 to 6 $CH_2CH_2O$ groups per molecule. Suitable 2-acyloxyalkane-1-sulphonates contain from 2 to 9 carbon atoms in the acyl group and from 9 to 23 carbon atoms in the alkane moiety. Suitable beta-alkyloxy alkane sulphonates contain from 1 to 3 carbon atoms in the alkyl group and from 8 to 20 carbon atoms in the alkane moiety.

The compositions herein can also contain fatty acids, saturated or unsaturated, and the corresponding soaps. Suitable fatty acids, saturated or unsaturated, have from 10 to 18 carbon atoms in the alkyl chain. Preferred are unsaturated species having from 14 to 18 carbon atoms in the alkyl chain, most preferably oleic acid. The corresponding soaps can also be used. Total fatty acid should comprise less than 5% of the composition.

Nonionic surfactants suitable for use in the compositions herein, are water-soluble ethoxylated materials of HLB 11.5–17.0 and include $C_{10-20}$ primary and secondary alcohol ethoxylates and $C_{6-10}$ alkylphenol ethoxylates. $C_{14-18}$ linear primary alcohols condensed with from seven to thirty moles of ethylene oxide per mole of alcohol are preferred examples being $C_{14}$–$C_{15}$ $(EO)_7$, $C_{16-18}$ $(EO)_{25}$ and especially $C_{16-18}$ $(EO)_{11}$.

Another class of nonionic surfactants comprises alkyl polyglucoside compounds of general formula $$RO(C_nH_{2n}O)_tZ_x$$

wherein Z is a moiety derived from glucose; R is a saturated hydrophobic alkyl group that contains from 12 to 18 carbon atoms; t is from 0 to 10 and n is 2 or 3; x is from 1.3 to 4, the compounds including less than 10% unreacted fatty alcohol and less than 50% short chain alkyl polyglucosides. Compounds of this type and their use in detergent are disclosed in EP-B 0,070,077; 0,075,996 and 0,094,118.

Also suitable as nonionic surfactants are polyhydroxy fatty acid amide surfactants of the formula:

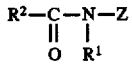

wherein $R^1$ is H, $C_{1-4}$ hydrocarbyl, 2-hydroxy ethyl, 2-hydroxy propyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or alkenyl chain such as coconut alkyl or mixtures thereof, and Z is derived from a reducing sugar such as glucose, fructose, maltose, lactose, in a reductive amination reaction.

Other suitable nonionics which may be used include aldonamides such as are taught in U.S. Pat. No. 5,389,279 to Au et al. and polyhydroxy amides such as are taught in U.S. Pat. No. 5,312,954 to Letton et al., both of which references are hereby incorporated by reference into the subject application.

Other types of surfactants can be used, such as zwitterionic amphoteric, as well as cationic surfactants.

Cationic co-surfactants which can be used herein, include water soluble quaternary ammonium compounds of the form $R_4 R_5 R_6 R_7 N^+ X^-$, wherein $R_4$ is alkyl having from 10 to 20, preferably from 12–18 carbon atoms, and $R_5$, $R_6$ and $R_7$ are each $C_1$ to $C_7$ alkyl preferably methyl; $X^-$ is an anion, e.g., chloride. Examples of such trimethyl ammonium compounds include $C_{12-14}$ alkyl trimethyl ammonium chloride and cocoalkyl trimethyl ammonium methosulfate.

The compositions according to the present invention comprise from 1 to 50% by weight of surfactant, preferably from 5% to 45%, most preferably from 5% to 40%.

An example of an amphoteric surfactant which may be used includes betaine.

Builders

The aqueous detergent compositions of the invention also generally comprise builders.

Suitable builders for use herein include the nitrilotriacetates, polycarboxylates, citrates, water soluble phosphates such as tri-polyphosphate and sodium ortho- and pyro-phosphates, and mixtures thereof. Metal ion sequestrants include all of the above, plus materials like ethylenediaminetetraacetate, the aminopolyphosphonates and a wide variety of other poly-functional organic acids and salts too numerous to mention in detail here. See U.S. Pat. No. 3,579,454 for typical examples of the use of such materials in various cleaning compositions. Preferred poly-functional organic acids species for use herein are citric acid, ethylene diamine tetramethylenephosphonic acid, and diethylene triaminepentamethylenephosphonic acid.

A further class of detergency builder materials useful in the present invention are insoluble sodium aluminosilicates.

The 1–10 micron size zeolite (e.g., zeolite A) builder disclosed in German Patent 24 22 655 are especially preferred for use in low-phosphate compositions.

The compositions herein can also contain fatty acids, saturated or unsaturated, and the corresponding soaps. Suitable fatty acids, saturated or unsaturated, have from 10 to 18 carbon atoms in the alkyl chain. Preferred are unsaturated species having from 14 to 18 carbon atoms in the alkyl chain, most preferably oleic acid. The corresponding soaps can also be used. Again, total fatty acids can comprise no more than 5% of the composition.

The compositions herein can also contain compounds of the general formula R—CH(COOH)$CH_2$(COOH) i.e., derivatives of succinic acid, wherein R is $C_{10}$–$C_{20}$ alkyl or alkenyl, preferably $C_{12}$–$C_{16}$ or wherein R may be substituted with hydroxyl, sulfo, sulfoxy or sulfone substituents.

The succinate builders are preferably used in the form of their water soluble salts, including the sodium, potassium, ammonium and alkanolammonium salts.

Specific examples of succinate builders include: lauryl succinate, myristyl succinate, palmityl succinate, 2-dodecenyl succinate (preferred), 2-pentadecenyl succinate, and the like.

Also useful as builders in the present context are the compounds described in U.S. Pat. No. 4,663,071, i.e., mixtures of tartrate monosuccinic acid and tartrate disuccinic acid in weight ratio of monosuccinic to disuccinic of from 97:3 to 20:80, preferably 95:5 to 40:6.

Compositions according to the present invention comprise from 0% to 20% of a builder, preferably from 1% to 15%, most preferably from 2% to 10%.

The detergent compositions of the invention are also preferably pH jump compositions. a pH jump heavy duty liquid (HDL) is a liquid detergent composition containing a system of components designed to adjust the pH of the wash liquor. To achieve the required pH regimes, a pH jump system can be employed in this invention to keep the pH of the product low for enzyme stability in multiple enzyme systems (e.g., protease and lipase systems), yet allow it to become moderately high in the wash for detergency efficacy. One such system is borax-polyol. Borate ion and certain cis 1,2 polyols complex when concentrated to cause a reduction in pH. Upon dilution, the complex dissociates, liberating free borate to raise the pH. Examples of polyols which exhibit this complexing mechanism with borax include catechol, galactitol, fructose, sorbitol and pinacol. For economic reasons, sorbitol is the preferred polyol.

Sorbitol or equivalent component (i.e., 1,2 polyols noted above) is used in the pH jump formulation in an amount from about 1 to 25% by wt., preferably 3 to 15% by wt. of the composition.

Borate or boron compound is used in the pH jump composition in an amount from about 0.5 to 10.0% by weight of the composition, preferably 1 to 5% by weight.

Stabilization System

The stabilization system used in the subject invention is a specific ternary system which has been found unexpectedly to remarkably enhance stability of EG III relative to the individual effect of any one of the ingredients.

One component of the ternary stabilization system is a water soluble (i.e., greater than 0.1% solubility in water at room temperature), hydrophobic, nonionic polymer. It can be any such polymer which binds to an anionic surfactant. Examples of such polymers include polyvinylpyrrolidone (PVP) and copolymers of vinyl pyrrolidone with nonionic monomers such as styrene; polyalkyleneglycols (e.g., PEG); ethylene oxide-propylene oxide copolymers; polypropylene oxide; vinyl imidazole or copolymers of vinyl imidazole with vinyl pyrrolidone compounds; polyvinylacetate; polyvinylalcohol; and polyamine N-oxides (e.g., polyvinyl pyridine N-oxide). A particularly preferred polymer is polyvinylpyrrolidone. Preferred polyvinylpyrrolidone should have a MW of from about 1000 to 100,000, preferably 1,500 to 50,000. In general, polymers will have MW of about 1,000 to 100,000, preferably 3,000 to 50,000.

The nonionic polymers generally comprise 0.1% to 10% by wt., preferably 0.5% to 5% by wt. of the composition.

A second component of the ternary stabilization system is an alkylene glycol, preferably a $C_2$–$C_6$ alkylene glycol, such as ethylene or propylene glycol. A preferred compound is propylene glycol.

The alkylene glycol generally comprises at least 5% by wt. of the composition, preferably 5% to 25%, more preferably 5% to 20% by wt. of the composition.

Finally, the third component of the composition is a hydrophilic amine compound. Preferred amines are the alcohol amines such as monoethanolamine, triethanolamine or diethanolamine. The amine should comprise at least 0.5% by wt. of the composition but should comprise no more than about 7% by wt. Higher amounts will lead to instability as shown in the examples.

Cellulase

The enzyme used in the present invention is Endoglucanase III, such as described in U.S. Pat. No. 5,419,778 to Clarkson et al., assigned to Genencor.

The term "EG III cellulase" or "EG III" refers to the endoglucanase component derived from Trichoderma spp. characterized by a pH optimum of about 5.5 to 6.0, an isoelectric point (pI) of from about 7.2 to 8.0, and a molecular weight of about 23 to 28 KD (Kilo Daltons). Preferably, EG III cellulase is derived from either *Trichoderma longibrachiatum* or from *Trichoderma viride*. EG III cellulase derived from *Trichoderma longibrachiatum* has a pH optimum of about 5.5 to 6.0, an isoelectric point (pI) of about 7.4 and a molecular weight of about 25 to 28 Kdaltons. EG III cellulase derived from *Trichoderma viride* has a pH optimum of about 5.5, and isoelectric point (pI) of about 7.7 and a molecular weight of about 23.5 KD.

The enzyme comprise 0.001 to 5.0% by wt. of the composition and has an activity of 100 to 5000 RBB-CMC (Remazol Brilliant Blue R-Carboxymethylcellulose). This unit of activity is a well-known way of measuring cellulase activity as is described more fully, for example in U.S. Pat. No. 5,419,778 to Clarkson et al., noted above. The Clarkson et al. reference is hereby incorporated by reference into the subject application.

Optional Ingredients

Apart from the ingredients already mentioned, a number of optional ingredients may also be present, for example lather boosters such as alkanolamides, particularly the monoethanolamides derived from palmkernel fatty acids and coconut fatty acids, fabric softeners such as clays, amines and amine oxides, lather depressants, inorganic salts such as sodium sulphate, and, usually present in very minor amounts, fluorescent agents, perfumes, and colorants.

Other conventional materials may also be present in the liquid detergent compositions of the invention, for example soil-suspending agents, hydrotropes, corrosion inhibitors, dyes, perfumes, silicates, other enzymes (e.g. proteases, lipases, peroxidases, amylases, and endoglycosidases), optional brighteners, suds boosters, suds depressants, germicides, opacifiers, fabric softening agents, buffers and the like.

The following examples are intended to further illustrate the invention and are not intended to limit the invention in any way.

All percentages, unless stated otherwise, are intended to be percentages by weight.

EXAMPLES

The following materials and methodology were used:

Materials

Surfactants: Linear alkylbenzenesulfonic acid (LAS acid) was purchased from Vista Chemicals. Alcohol ether sulfate (AES) was supplied by Stepan Chemicals. Alcohol ethoxylate ($C_{12-15}$ $EO_9$) was supplied by Shell Chemicals.

Inorganic Reagents: Sodium citrate dihydrate and sodium borate decahydrate used were of technical grade and were purchased from Archer Daniels Midland and U.S. Borax respectively. 50 weight percent sodium hydroxide of analytical reagent grade was supplied by Fisher Scientific Company.

Other Reagents: Propylene glycol (PPG), glycerol, monoethanolamine (MEA) and triethanolamine (TEA) were purchased from Fisher Scientific and tetraethyl ammonium bromide was purchased from Aldrich. Sorbitol was purchased from ICI. Deionized water was used in all the formulations and for reagent dilution.

Polymers: Polyvinylpyrrolidone (PVP) of molecular weight 10,000 Daltons was purchased from Aldrich Chemicals and polyethylene glycol (PEG) of molecular weight 3350 Daltons was purchased from Union Carbide.

Enzyme: Endoglucanase III (EG III) used in the tests was supplied by Genencor. Celluzyme used in the tests was supplied by Novo Nordisk.

Methods

Procedure for Preparation of Liquids: The formulations were prepared by adding desired levels of sodium citrate and sodium borate to water at 40° C. in a 250 to 500 ml beaker. A magnetic stir bar was used to mix the contents. When the solution became clear, known amounts of sorbitol, glycerol and the nonionic polymer were added followed by amine sodium hydroxide, LAS acid and Neodol 25-9. The mixture was then cooled down to 25° C. and the necessary amount of AES was added. Enzymes were dosed into the formulation in the end.

Determination of Enzyme Stability: Cellulase was dosed into the various formulations and well mixed. The initial enzyme activity in the enzyme dosed formulations was measured and considered as 100% activity remaining. The formulations were then stored at 37° C. The enzyme activity remaining after a 2 week storage period was analyzed and compared to the initial enzyme activity. Cellulase assay was routinely carried out according to a method based on the determination of reducing sugars generated by cellulase action. The reaction of reducing sugars with p-hydroxybenzoic acid hydrazide (PAHBAH) was colorimetrically measured at 405 nm.

Typical formulations prepared for purposes of the invention were as follows:

| | Weight Percent | | |
|---|---|---|---|
| Component | Formulation I | Formulation II | Formulation III |
| Alcohol ethoxylate | 8.0 | 14.0 | 8.0 |
| Alcohol ether sulfate (AES) | 8.0 | 8.0 | 14.0 |
| LAS acid | 13.5 | 7.5 | 7.5 |
| NaOH (50% solution) | 0–3.5 | 0–2.0 | 0–2.0 |
| Amine | 0–4.0 | 0–4.0 | 0–4.0 |
| Propylene glycol (PPG) | 0–14.0 | 0–14.0 | 0–15.5 |
| Polyvinyl pyrrolidone (PVP) | 0–3.0 | 0–3.0 | 0–3.0 |
| Sorbitol | 4.5 | 4.5 | 4.5 |
| Sodium borate $10H_2O$ | 4.0 | 4.0 | 4.0 |
| Sodium citrate $2H_2O$ | 2.5 | 2.5 | 2.5 |
| Enzyme | 0.15–2.0 | 0.15 –2.0 | 0.15 –2.0 |
| Deionized water | to 100 | to 100 | to 100 |

Remarks:
* The pH of the liquid was adjusted to 7.0.
* The ratio of LAS: alcohol ethoxylate: AES is 2:1:1 in Form. I; 1:2:1 in Form. II; and 1:1:2 in Form. III.

Example I

Effect of propylene glycol (PPG), monoethanolamine (MEA) and polyvinylpyrrolidone (PVP) on EG III stability in typical formulations.

| Additive/s - | Percent Residual EG 3 Stability After 14 Days Storage at 37° C. | | |
|---|---|---|---|
| wt. % | Formulation I | Formulation II | Formulation III |
| A 6.0 PPG (7.5 in Form. III) | 0 | 0 | <1 |
| B 14.0 PPG (15.5 in Form. III) | 0 | 0 | <1 |
| C 2.0 MEA | — | — | 0 |
| D 3.0 PVP | — | — | 2 |
| E 6.0 PPG + 2.0 MEA (7.5 PPG in Form. III) | — | 8 | 4 |
| F 3.3 PPG + 2.0 MEA + 3.0 PVP | — | — | 7 |
| G 6.0 PPG + 2.0 MEA + 3.0 PVP (7.5 PPG in Form. III) | — | 60 | 63 |
| H 14.0 PPG + 2.0 MEA (15.5 PPG in Form. III) | 12 | 40 | 32 |
| I 14.0 PPG + 2.0 MEA + 3.0 PVP (15.5 PPG in Form. III) | 37 | 88 | 91 |

This example shows that the synergistic beneficial effect of PPG, MEA and PVP (that is when they are present together) far exceeds the additive effects of these ingredients. In Form. III the residual activity obtained in the presence of 15.5% PPG, 2% MEA and 3% PVP together (see I) is 91 percent. The residual activity, in Formulation III, in the presence of 15.5% PPG alone (see B) is <1, 2% MEA alone (see C) is 0 and 3% PVP alone (see D) 2 and the additive effect is thus <3. This example also shows the synergistic effect of PPG and MEA (see E & H).

Further, the example shows that greater than 3.3%, preferably greater than 5% (e.g., 6%) PPG is required for good stability.

Example II

Effect of polyvinylpyrmlidone (PVP) concentration on EG III stability in the presence of 14.0 wt. % propylene glycol (15.5 wt. % propylene glycol in Formulation III) and 2.0 wt. % monoethanolamine (MEA).

| | % Residual EG III Activity After 14 Days Storage at 37° C. | |
|---|---|---|
| PVP Concentration - wt. % | Formulation II | Formulation III |
| 0.0 | 40 | 47 |
| 0.5 | 65 | 88 |
| 1.0 | 89 | 75 |
| 3.0 | 87 | 100 |

This example shows that the synergistic effect of PVP with MEA and PPG can be obtained in the entire tested PVP concentration range of 0.5 to 3.0 wt. %.

Example III

Effect of monoethanolamine (MEA) concentration on EG III stability in the presence of 14.0 wt. % propylene glycol (15.5 wt. % propylene glycol in Formulation III) and 3.0 wt. % polyvinylpyrrolidone (PVP).

| | % Residual EG III Activity After 14 Days Storage at 37° C. | |
|---|---|---|
| MEA Concentration - wt. % | Formulation II | Formulation III |
| 0.0 | — | 26 |
| 1.0 | 97 | 79 |
| 2.0 | 87 | 100 |
| 4.0 | 100 | 100 |

This example shows that the synergistic effect of MEA with PVP and PPG can be obtained in the entire tested MEA concentration range of 1.0 to 4.0 wt. %

Example IV

Effect of different amines on EG III stability in the presence of 14.0 wt. % propylene glycol (15.5 wt. % propylene glycol in Formulation III) and 3.0 wt. % polyvinylpyrrolidone (PVP).

| | Amine Concn. | % Residual EG III Activity After 14 Days Storage at 37° C. | |
|---|---|---|---|
| Amine | wt. % | Formulation II | Formulation III |
| Amine | None | — | 26 |
| Monoethanolamine | 4.0 | 100 | 100 |
| Triethanolamine | 4.0 | 49 | 49 |
| Tetraethylamine | 4.0 | 31 | 13 |

This example shows that hydrophilic amines (monoethanolamine and triethanolamine) are better than hydrophobic amine (tetraethylamine).

Example V

Effect of polyethylene glycol (PEG) addition on EG III stability in the presence of 14.0 wt. % propylene glycol (15.5 wt. % propylene glycol in Formulation III) and 2.0 wt. % monoethanolamine (MEA).

| | % Residual EG III Activity After 14 Days Storage at 37° C. | |
|---|---|---|
| PEG Concentration - wt. % | Formulation II | Formulation III |
| 0.0 | 40 | 32 |
| 3.0 | 53 | 54 |

This example shows that addition of polyethylene glycol also has a beneficial effect on EG III stability, but the magnitude is much less than that obtained with polyvinylpyrrolidone (see Example II).

Example VI

Effect of propylene glycol (PPG), monoethanolamine (MEA) and polyvinylpyrrolidone (PVP) on Celluzyme stability in a typical formulation.

| Additive/s wt. % | Percent Residual EG III Stability After 14 Days Storage at 37° C. Formulation II |
|---|---|
| 6.0 PPG | 59 |
| 14.0 PPG | 60 |
| 6.0 PPG + 2.0 MEA | 62 |
| 6.0 PPG + 2.0 MEA + 3.0 PVP | 66 |
| 14.0 PPG + 2.0 MEA | 63 |
| 14.0 PPG + 2.0 MEA + 3.0 PVP | 62 |

This example shows that PPG, MEA and PVP has no effect on the stability of Celluzyme. Thus, the effect of PPG, MEA and PVP appears to be specific to EG III.

Example VII

| | Weight Percent | |
|---|---|---|
| Composition | I | II |
| Alcohol Ethoxylate | 8.0 | 8.0 |
| AES | 14.0 | 14.0 |
| LAS Acid | 7.5 | 7.5 |
| Monoethanolamine | 6.0 | 8.0 |
| Propylene Glycol | 12.0 | 12.0 |
| Polyvinylpyrrolidone | 0.5 | 0.5 |
| Sorbitol | 4.5 | 4.5 |
| Sodium Borate .10$H_2O$ | 4.0 | 4.0 |
| Sodium Citrate .2$H_2O$ | 0.0 | 0.0 |
| Deionized Water | to 100 | to 100 |

When the pH of the formulations was adjusted down to 7.0 using sulfuric acid, the formulation containing 6 wt. % monoethanolamine remained clear, while that containing 8 wt. % to monoethanolamine became hazy. Thus about 7 wt. % monoethanolamine defines the upper limit of amine.

Example VIII

Surfadone LP-100 (octyl 2-pyrrolidone) and Polectron 430 (vinyl pyrrolidone/styrene copolymer) were obtained from ISP. Sokalan HP-56 (vinylpyrrolidone/vinylimidazole copolymer) was obtained from BASF.

The base formulation consisted of:

| Ingredient | Parts |
|---|---|
| Sodium citrate 2 $H_2O$ | 2.5 |
| Propylene glycol | 15.7 |
| Sorbitol | 4.5 |
| Sodium borate 5 $H_2O$ | 3.1 |
| Alcohol ethoxylate | 8.0 |
| Alcohol ether sulfate | 14.0 |
| Deionized water | 20.0 |

| | Weight percent | | | | | | | | |
|---|---|---|---|---|---|---|---|---|---|
| Ingredient | 1 | 2 | 3 | 4 | 5 | 6 | 7 | 8 | 9 |
| Base formulation | | | | | 67.8 | | | | |
| Sodium linear alkylbenzene sulfonate (LAS) | 8.0 | 8.0 | 8.0 | 8.0 | 8.0 | 8.0 | 8.0 | 4.0 | 4.0 |
| Monoethanolamine | 0.0 | 0.4 | 0.8 | 0.4 | 0.4 | 0.8 | 0.8 | 0.8 | 0.8 |
| Coconut fatty acid | 0.0 | 1.6 | 3.2 | 1.6 | 1.6 | 3.2 | 3.2 | 3.2 | 3.2 |
| Polyvinylpyrrolidone | 0.0 | 0.0 | 0.0 | 1.0 | 3.0 | 1.0 | 3.0 | 1.0 | 3.0 |
| Deionized water | | | | | to 100 | | | | |
| EG 3 stability after 2 weeks at 37° C. (%) | 10 | 14 | 31 | 44 | 65 | 54 | 78 | 55 | 86 |

| | Weight percent | | | | | |
|---|---|---|---|---|---|---|
| Ingredient | 10 | 11 | 12 | 13 | 14 | 15 |
| Base formulation | | | 67.8 | | | |
| Sodium linear alkylbenzene sulfonate | 8.0 | 8.0 | 8.0 | 8.0 | 8.0 | 4.0 |
| Monoethanolamine | 0.8 | 2.0 | 2.0 | 2.0 | 2.0 | 2.0 |
| Coconut fatty acid | 3.2 | 0.0 | 0.0 | 0.0 | 0.0 | 0.0 |
| Polyvinylpyrrolidone | 0.0 | 0.0 | 0.0 | 0.0 | 1.0 | 0.0 |
| Surfadone LP-100 | 1.0 | 0.0 | 0.0 | 0.0 | 0.0 | 0.0 |
| Polectron 430 | 0.0 | 0.0 | 0.0 | 0.0 | 0.0 | 1.0 |
| Sokalan HP-56 | 0.0 | 1.0 | 3.0 | 0.0 | 0.0 | 0.0 |
| Deionized water | | | to 100 | | | |
| Residual EG 3 stability after 2 weeks at 37° C. (%) | 16 | 71 | 67 | 52 | 79 | 70 |

Formulation 1 contains one of the stabilization system ingredients (15.7% propylene glycol). Formulation 2 (with 2% MEA soap added) has approximately parity EG III stability as formulation 1; increasing the MEA soap level to 4% (formulation 3) improves stability over formulations 1 and 2. Addition of PVP to formulations 2 and 3 (formulations 4 through 7) improves EG III stability further; higher levels of MEA soap (formulations 6 and 7) and higher levels of PVP (formulations 5 and 7) give increased EG III stability.

In formulations 1, 8 and 9, the total surfactant level is fixed at 30 weight percent. Formulations 8 and 9, which contain the full stabilization system, show improved EG III stability over formulation 1. The higher PVP level (formulation 9) has the best stability of the three formulations.

In formulations 3, 6 and 10, 4% MEA soap is incorporated. In formulation 10, Surfadone LP-100 is incorporated at 1%; its EG III stability is lower than that of formulation 3, with no pyrrolidone-based material, and formulation 10, with polyvinylpyrrolidone. Thus, the n-octyl-2-pyrrolidone does not contribute to the stabilization system for EG III.

In formulations 11–15, a constant level of 2% monoethanolamine is maintained in addition to the 15.7% propylene glycol. Formulation 13 does not contain pyrrolidone-based materials; formulations 11 and 12 contain Sokalan HP-56, which gives an EG III stabilization benefit. Formulation 14 contains polyvinylpyrrolidone, which also gives a stabilization benefit. Formulation 15 contains Polectron 430, which also gives a stabilization benefit.

In conclusion, it was found that in the liquids containing both monoethanolamine and propylene glycol, polyvinylpyrrolidone and two different nonionic copolymers containing vinylpyrrolidone gave EG III stability improvements over formulations without the polymer present.

We claim:

1. An aqueous surfactant composition comprising:

(1) 1% to 50% by weight of a surfactant selected from the group consisting of anionic, nonionic, cationic, zwitterionic and amphoteric surfactant and mixtures thereof;

(2) A ternary system for stabilizing Endoglucanase III comprising:

(a) 0.1 to 5% by wt. total composition of a water-soluble, hydrophobic nonionic polymer which is selected from the group consisting of polyvinylpyrrolidone, copolymer of vinyl pyrrolidone and vinyl imidazole, and a copolymer of vinyl pyrrolidone and styrene;

(b) 5% to 25% by wt. total composition of a $C_2$–$C_6$ alkylene glycol;

(c) 0.5% to 7.0% by wt. total composition of a alkanolamine; and (3) 0.001% to 5.0% by wt. Endoglucanase III having an activity of 100 to 5,000 RBB-CMC activity;

wherein fatty acid content is below about 5%; and wherein said composition comprises greater than 30% by wt. water.

2. A composition according to claim 1, wherein alkylene glycol is propylene glycol.

3. A composition according to claim 1, additionally comprising 11% to 20% builder.

4. A composition according to claim 3, wherein the builder is citrate.

5. A composition according to claim 1, which comprises pH jump system.

* * * * *